United States Patent [19]

Dickinson

[11] 4,284,015

[45] Aug. 18, 1981

[54] POLLUTION-FREE COAL COMBUSTION PROCESS

[76] Inventor: Norman L. Dickinson, 16230 Greenwood La., Monte Sereno, Calif. 95030

[21] Appl. No.: 23,606

[22] Filed: Mar. 26, 1979

[51] Int. Cl.[3] ..... F23D 1/00

[52] U.S. Cl. ..... 110/347; 44/15 R; 110/218; 110/342; 110/343; 110/345; 431/2

[58] Field of Search ..... 110/218, 232, 263, 342, 110/343, 345, 347; 431/2 X, 3, 4; 44/1 SR, 51

[56] References Cited

U.S. PATENT DOCUMENTS

| | | | |
|---|---|---|---|
| 3,229,650 | 1/1966 | Reichl | 110/347 |
| 3,229,651 | 1/1966 | Wasp | 110/347 |
| 4,008,053 | 2/1977 | Brenneman et al. | 44/1 D |
| 4,071,328 | 1/1978 | Simke | 44/15 R |
| 4,173,454 | 11/1979 | Heins | 44/15 R |

*Primary Examiner*—Edward G. Favors

[57] ABSTRACT

A continuous process for the combustion of solid fuels in the presence of strong sulfuric acid under conditions such that oxides of nitrogen are not formed and oxides of sulfur and particles of ash are effectively prevented from contaminating the gaseous products released to the atmosphere.

9 Claims, 1 Drawing Figure

POLLUTION-FREE COAL COMBUSTION PROCESS

BACKGROUND OF THE INVENTION

This invention concerns the utilization of the heating values of carbonaceous fuels for the production of useful thermal, mechanical or electrical energy.

Burning coal to generate steam is one of the oldest of the industrial arts. Numerous inventions have been applied to improving its efficiency and alleviating the co-production of noxious smoke which tends to contain unburned fuel, finely powdered ash and oxides of sulfur and nitrogen. Nevertheless, even with the latest technology, coal is considered a dirty fuel capable only with great difficulty and expense of complying with increasingly stringent air pollution standards.

The high cost of removing sulfur oxides from conventional flue gasses has resulted in a spread between the prices of low and high sulfur coals. Moreover, the former are found, for the most part, in western states remote from the areas of greatest energy need. Thus, the market price structure provides economic incentive for a process able to produce steam and power from high sulfur coals without polluting the air.

Combustion of coal in conventional ways creates temperatures well above 2000 degrees F. Apparatus must therefor be constructed of expensive materials capable of withstanding such temperatures. Moreover, components of the ash frequently melt (slag) forming deposits which foul parts of the apparatus. A further undesirable consequence of the usual combustion temperatures is the inadvertent formation of nitrogen oxides, pollutants which cannot be removed economically with available technology.

Generation of high pressure steam, as utilized in modern power plants, does not inherently require such high temperatures since the boiling point of water at 2000 pounds per square inch is only about 635 degrees F. and at 3000 pounds per square inch less than 700 degrees F.

Some experimental combustion systems, particularly those employing fluidized beds of finely divided solids at elevated pressure, permit combustion in a lower temperature range, typically 1500 to 1700 degrees F. Although nitrogen oxides are thus largely avoided, expensive temperature-resistant construction is still required and new difficulties associated with the maintenance of fluidized solids properties, erosion and removal of dust from gas streams are entailed.

It has also been proposed to burn coal without air pollution by the indirect means of first converting it to liquid or gaseous fuel which can be desulfurized by known technology. These techniques also employ high temperatures and generally share serious economic and operational drawbacks associated with coal's tendency to cake and stick when heated, the formation of tarry residues and difficulties with erosion and dust control. They are further burdened by low overall thermal efficiencies.

It has long been known that liquid water accelerates the reaction between coal and atmospheric oxygen so that it is at least possible that finely divided coal in the form of an aqueous slurry can be burned at temperatures much lower than those of conventional combustion, perhaps 550 to 700 degrees F. The laws of thermodynamics teach us that such a process would oxidize sulfur compounds in the coal to the trioxide rather than the dioxide encountered in conventional flue gasses and that the formation of oxides of nitrogen would be essentially nil. Sulfur trioxide is highly soluble in water, combining with it to form sulfuric acid, whereas the solubility of the dioxide is comparatively low. Thus, the flue gas from such a process could be essentially free of oxides of both sulfur and nitrogen. Moreover, particles of ash would be expected to remain with the aqueous phase.

In the indicated temperature range water has a vapor pressure of approximately 1000 to 3000 pounds per square inch. Operating pressure necessary to maintain liquid phase would be even higher because of the partial pressure effect of air or flue gas. The costs of compressing combustion air to such pressure levels would be a serious handicap for such a process. Also, water's critical temperature of about 705 degrees F., above which liquid phase does not exist, limits the level at which useful heat can be delivered.

It is interesting and significant that sulfur contained in a fuel charged as a slurry in a liquid containing at least some water, and burned at relatively low temperature, becomes sulfuric acid. Moreover, if not neutralized or withdrawn, this acid, being substantially less volatile than water, will accumulate and become increasingly concentrated. It happens that this familiar reagent and chemical commodity has properties useful to creating a new and novel slurry-phase combustion process, capable of producing pollution-free flue gas without the necessity of high operating pressure and its attendant air compression costs.

Among the pertinent properties of sulfuric acid is extreme stability to heat and oxidation. Secondly, its vapor pressure is quite low so that temperatures suitable for the generation of high pressure steam can be achieved at relatively low levels of superimposed pressure. Thirdly, it is a powerful oxidizing agent in its own right and may be expected to accelerate the combustion reactions. An important economic consideration is that, as a by-product, its supply does not represent an operating cost. On the contrary, a modest surplus, the amount being a function of the sulfur content of the fuel, would be available for sale.

Also pertinent are the chemical interactions among sulfur dioxide, oxygen, sulfur trioxide, water vapor and sulfuric acid. The thermodynamic equilibria among these components have been accurately determined and form part of the fundamental data upon which the commercial manufacture of sulfuric acid is based. In general, increased pressure, oxygen and water concentrations and decreased temperature favor the trioxide or sulfuric acid form, all of which conditions can be manipulated to limit the production of the undesirable dioxide to a very low tolerance.

In the large body of art concerning the control of pollution from conventional coal combustion, sulfuric acid appears in at least two roles. In one, flue gas containing sulfur dioxide is passed, at a temperature substantially lower than the combustion temperature, over a catalyst similar to that used in the contact process of sulfuric acid manufacture. The sulfur dioxide is thereby converted to the trioxide which unites with water vapor to become liquid sulfuric acid which is then separated from the flue gas. In another role, flue gasses are scrubbed with strong sulfuric acid which acts as a solvent for sulfur dioxide and oxides of nitrogen. Both of these processes rely on the extreme stability and low vapor pressure of this acid.

There is also a sizeable body of art concerning the concentrating of dilute solutions of sulfuric acid which furnishes information useful to controlling the water content of an acid solution used as a slurrying medium in a novel combustion process. In some examples of this art water is vaporized from the acid by direct contact with hot flue gas and, in at least one such process, this contact results from combustion (in the conventional temperature range) under the liquid surface, a technique referred to as "submerged combustion". Experience with the operation of these acid concentrating processes is also useful to the selection of materials of construction for an acid slurry combustion process.

SUMMARY OF THE INVENTION

Powdered coal is slurried in recycled sulfuric acid solution to which a little dilute acid may be added for control of acid concentration and pumped to the pressure of the reaction system. The pressurized slurry is normally preheated by exchange, for example with hot ash slurry leaving the system. When processing comparatively reactive fuels it is sometimes advisable to inject a little air into the slurry being preheated to suppress the formation of sulfur dioxide. After preheating it is joined by the remainder of the combustion air and the mixture passes through a reaction zone in which combustion takes place with the liberation of heat. Reaction zone temperature is controlled by the indirect transfer of heat to boiling water, saturated steam or other heat transfer medium, and/or by recycling ash slurry. Sufficient pressure is imposed on the reaction zone to maintain the acid solution substantially in liquid phase.

After leaving the reaction zone the mixture is separated into gaseous and slurry phases, the net ash slurry being cooled by heat exchange before being let down to atmospheric pressure. It is then separated, for example by filtration, into ash, which would usually be washed and may also be neutralized before disposal, and acid solution the bulk of which is recycled to the feed slurry. However, a portion of the separated acid must be removed from the system to dispose of the net production of acid and various salts dissolved from the coal.

Flue gas separated from the ash slurry contains water vapor and a small amount of sulfuric acid and sulfur trioxide. To prevent acidic components from escaping with the flue gas as well as to recover sensible heat, it is scrubbed with a recirculating acid solution which has been cooled by heat exchange with process streams able to utilize its surplus heat.

Any chlorides entering the system with the coal are converted to hydrogen chloride which passes through the contact with recirculating acid along with the flue gas. If in sufficient quantity to cause difficulty in subsequent equipment, or if released to the atmosphere, it may be condensed along with some of the accompanying water vapor, washed from the flue gas with water or neutralized by an alkaki or alkali solution as appropriate under the circumstances.

Depending upon system pressure and associated economics the flue gas may be released directly to the atmosphere or expanded through a power recovery turbine with or without prior superheating. If a flue gas turbine is employed it is normally coupled with the combustion air compressor.

The steam generated and/or superheated in the course of cooling the reactor, or other heated transfer medium, comprises the useful energy output of the combustion.

DESCRIPTION OF THE PREFERRED EMBODIMENT

Figure 1:
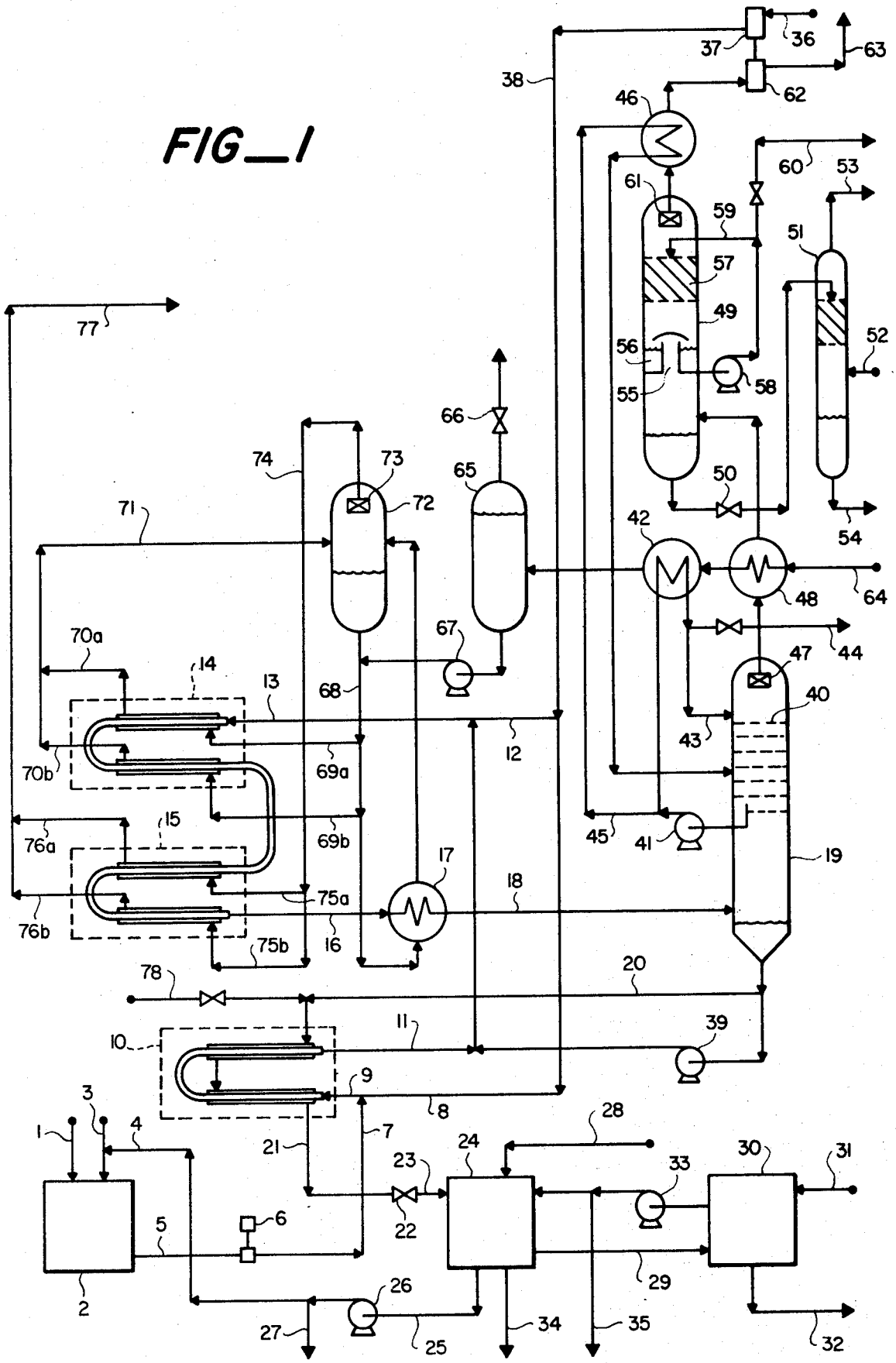
FIG. 1 is a schematic elevational diagram illustrating an apparatus for implementing one embodiment of the process of the invention.

With reference to FIG. 1, crushed coal from a suitable source is supplied through a conduit 1 to a conventional grinding and slurrying system 2 in which it is mixed with recycled acid solution from a line 4 which may be adjusted in concentration by the addition of water or dilute acid from offsite storage through a line 3. A coal slurry charge pump 6 draws the resulting slurry through a line 5 and provides sufficient pressure to cause it to flow through lines 7 and 9, a preheat exchanger 10, lines 11 and 13 to the inlet of a first stage reactor 14. Prior to entering the exchanger 10, which is illustrated as, but is not necessarily of, double-pipe type, a small amount of air may be injected into the slurry by means of a line 8 to suppress the reduction of sulfate ions with the possible liberation of sulfur dioxide.

In the exchanger 10 the coal slurry is preheated by indirect exchange with hot ash slurry leaving the reaction system via a line 20. It then moves through the line 11 to the point of mixing with combustion air from a line 12, the mixture flowing via the line 13 to the reaction system. The first stage reactor 14 comprises essentially a double-pipe heat exchanger as commonly employed in the chemical process industries except that its elements are carefully sized to provide the desired velocity and residence time in the reaction (inner pipe) side and sufficient heat transfer surface to control the reaction temperature with the desired temperature difference between reactants and boiling water in the outer pipes.

The effluent of the first stage reactor 14, comprising a mixture of partially burned coal slurry and partially exhausted air, flows to a second stage reactor 15, also a double-pipe heat exchanger with elements sized according to similar criteria except that the heat transfer surface takes into account that the coolant is saturated steam being superheated. While, for simplicity of illustration, two sections of double-pipe exchanger have been shown for each stage more than two sections are usually required on the commercial scale.

Upon completing its traverse of the reactor stages the flowing mixture comprises essentially flue gas and a slurry of ash particles which continues via a line 16 to a waste heat boiler 17. Indirect transfer of heat to boiling water in the boiler 17 cools the reaction effluent, which had risen in temperature during its passage through the second stage reactor 15, to approximately the temperature of the reactants in the first stage reactor 14. The cooled reaction effluent continues through a line 18 to an acid scrubber 19.

In the lower part of the acid scrubber 19 gravity causes the ash slurry to separate from the gaseous phase and collect in the bottom from which all, or a net portion, is withdrawn via a line 20 to the preheat exchanger 10 in which, as previously described, it gives up sensible heat to incoming coal slurry. Cooled ash slurry leaves the pressurized portion of the apparatus by means of a line 21 and a pressure reducing valve 22. A portion of the ash slurry from the bottom of the acid scrubber 19 may be recycled to the inlet of the first stage reactor 14 by means of an internal recycle pump 39.

Cooled ash slurry, now at essentially atmospheric pressure, flows through a line 23 to an ash separating system 24 in which conventional liquid-solids separating equipment, such as a filter, is used to separate the net production of ash from the slurrying acid, and in which the bulk of acid left clinging to the particles may be washed from them by fresh wash water from a line 28 and/or recycled wash water from a pump 33. Acid separated from the ash leaves the system 24 via a line 25 and an external recycle pump 26 which returns the greater part through the line 4 to the grinding and slurrying system 2. A smaller portion of the acid from the pump 26 leaves the apparatus through a line 27 as product acid which also serves to purge soluble constituents dissolved from the coal.

Used wash water, containing recoverable acid, may be sent to offsite storage by means of a line 34. The washed ash is conveyed, with the assistance of some of the recycled wash water, through a line 29 to an ash neutralization and dewatering system 30. In the system 30 conventional equipment such as an eductor or mixer is used to contact the washed ash with a neutralizing agent, such as a limestone slurry, entering by means of a line 31. Also, conventional dewatering equipment, such as a settler, may be employed to separate the neutralized ash from most of the accompanying water. The dewatered ash leaves the apparatus for disposal via a conduit 32 while the water may be recycled to the ash separating and washing system 24 by means of the pump 33 and/or withdrawn from the apparatus through a line 35.

Filtered atmospheric air enters the apparatus through a conduit 36 and is given sufficient pressure by a compressor 37 to flow through lines 38, 12 and 8 to the points of mixing with coal slurry. Depending upon the level of reaction pressure selected for a particular case it may be economical to preheat the air leaving the compressor 37 by indirect exchange (not shown) as, for example, with flue gas leaving the acid scrubber 19.

Referring again to the acid scrubber 19, the gaseous phase separated in the lower part flows upward through a rectification section consisting of a number of vapor liquid contacting elements such as perforated or bubble trays 40 in which it is contacted in counter-current manner with a recirculating acid solution. This solution, which is cooler than the entering gas, condenses from the gaseous phase some of its contained water vapor and essentially all of its small content of sulfuric acid vapor and sulfur trioxide. The net production of acid solution resulting from this interchange flows downward to join the ash slurry in the lower part of the vessel except that a portion may be withdrawn from the circulating stream by means of a line 44 if adjustment in acid concentration becomes desirable.

A portion of the acid solution recirculates via a pump 41, a boiler feedwater preheat exchanger 42 and a line 43 to the uppermost of the contact elements 40, in so doing transferring the heat it had removed from the hot flue gas to boiler feedwater entering the apparatus from offsite through a line 64. A further portion of the solution recirculated by the pump 41 flows via a line 45 to a flue gas reheat exchanger 46 in which it raises the temperature of flue gas on its way to a flue gas turbine 62. The acid solution cooled by this exchange returns to an intermediate contacting element of the acid scrubber 19.

Flue gas leaving the uppermost contacting element of the acid scrubber 19 is dried in a mist extractor 47 and then cooled by indirect exchange in a flue gas-boiler feedwater exchanger 48 in which part of its contained water vapor condenses along with essentially all of its content of hydrogen chloride (liberated by the action of hot sulfuric acid on chlorides in the coal). The cooling effect of the exchanger 48 may be augmented in some cases by additional heat exchange (not shown) as previously mentioned.

The mixture of cooled flue gas and aqueous condensate flows from the exchanger 48 to a flue gas neutralizer 49. In a lower compartment of this vessel the condensate separates by gravity for subsequent removal through a pressure reducing valve 50 to a hydrogen chloride stripper 51. In the stripper 51, which contains a section packed with material providing contact surface, low pressure steam entering through a line 52 desorbs the hydrogen chloride from the entering condensate, hydrogen chloride and uncondensed steam leaving the apparatus via a line 53. Residual water and condensed steam collect in the bottom of the stripper 51 and are withdrawn from the apparatus through a line 54.

Referring again to the flue gas neutralizer 49, flue gas separated in the lower compartment flows upward through a passage 55 and is caused to pass through a section 57 packed with material providing suitable contact surface in which it is scrubbed with a recirculating alkaline solution to insure that the last traces of acid gas are removed.

Alkaline solution, having flowed downward through the packed section 57, collects in a sump 56 from which it is drawn by a pump 58 for recirculation through a line 59 to the top of the packed section 57. Make-up alkaline solution is added to the circulating inventory from offsite as required, or spent solution withdrawn from the apparatus, through a line 60.

Neutralized flue gas is dried in a mist extractor 61 and flows to the flue gas reheat exchanger 46 in which, as previously described, it is heated by indirect exchange with recirculating acid solution. The flue gas then flows to the expansion turbine 62 in which potential energy by virtue of its temperature and pressure is recovered in the form of shaft horsepower. Expanded flue gas is vented to the atmosphere through a conduit 63.

The turbine 62 is coupled with and supplies power to the air compressor 37. A steam turbine or an electric motor (not shown), or both, may also be coupled with the turbine-compressor set to furnish power for bringing the unit on-stream or for providing a precise power balance during normal operation.

As previously described, boiler feedwater enters the apparatus via the line 64, is first preheated in the exchanger 48 and then preheated further in the exchanger 42. It then flows to a feedwater accumulator 65 in which traces of fixed gasses formerly dissolved in the water may be vented through a control valve 66. The accumulator 65 may be a vessel of proprietary design known as a "de-aerator". A boiler feedwater pump 67 draws the preheated water from the bottom of the accumulator 65 and delivers it to a line 68 under sufficient pressure to supply make-up water to a steam generating system comprising the outer pipes of the first reactor stage 14, the waste heat boiler 17 and a steam drum 72. Water recirculating from the bottom of the steam drum 72 joins the make-up feedwater in the line 68 the combined stream forming the feedwater supply, via lines **69*a* and 69*b*, to the first reactor stage 14 and to the waste heat boiler 17**.

Heat of combustion liberated during the passage of coal and air through the inner tubes of the first stage reactor 14 is transferred through the tube wall, causing some of the water fed to the outer pipes to boil. The resulting steam-water mixture leaves the outer pipes via lines 70*a* and 70*b*, joins in a line 71 and flows to the steam drum 72. Similarly, high level sensible heat in the reaction effluent in the line 16 is transferred in the waste heat boiler 17 to the water in the cold side of this unit, causing some of it to boil. The steam-water mixture resulting also flows to the steam drum 72 in which a separation is made between water, which recirculates through the line 68, as previously described, and steam, which leaves the steam drum 72 through a mist extractor 73. The dried steam flows through a line 74 to supply, via lines 75*a* and 75*b*, cooling medium to the outer pipes of the second stage reactor 15.

During the passage of partially burned coal and partially consumed air through the inner tubes of the second stage reactor 15 additional combustion heat is liberated, causing the temperature of the flowing mixture to rise until a thermal equilibrium is established between the rate of heat release and the rate of heat transfer through the walls to the steam passing through the outer pipes. This transfer prevents the temperature in the inner tubes from becoming excessive while imparting useful superheat to the product steam which leaves the second stage reactor 15 via lines 76*a* and 76*b* and the apparatus as a whole through a line 77.

To prevent accumulation of dissolved solids in the water circulating through the steam system a small amount, known as "blow-down", is continuously or intermittently withdrawn through connections not shown.

Among various ways in which the apparatus may be brought up to operating temperature from a cold start, steam from an outside source can be brought in through a line 78 to temporarily replace hot ash slurry as a heating medium in the coal slurry preheat exchanger 10.

DESCRIPTION OF THE INVENTION

For convenience in the description of the invention and its preferred embodiment I have referred to carbonaceous fuels as coal. It is to be understood, however, that it applies similarly to any solid or semi-solid combustible material including, but not limited to, petroleum coke, char, lignite, waste wood products and fuels of vegetable or organic origin known collectively as "biomass". Since water vaporized during the combustion is not recondensed at a temperature high enough to generate high pressure steam, the most suitable fuels are those which are dry and/or have relatively low hydrogen contents.

Coal is ordinarily received, stored, conveyed and crushed in ways familiar to the thermal power industry. It may also be pulverized in grinding mills similar to those used for preparing fuel for conventional powdered coal burners. However, in many cases, it is more convenient to employ some of the known wet grinding techniques, using recycled and/or make-up acid solution as the liquid medium.

Sufficient acid separated from ash slurry (external recycle) is mixed with the coal particles to form a coal slurry suitable for pumping to reaction pressure. Dilute acid from such sources as washing ash, draining or cleaning the equipment during shutdowns, may be added to the slurry, water balance of the particular case permitting, as a means of recovering and reconcentrating them.

Depending upon the reactivity of the fuel charged and the temperature of the slurrying system there may be a tendency for some sulfur dioxide to be evolved. In such cases, this may be avoided by bubbling low pressure air through the slurry. Similarly, a small amount of the high pressure combustion air may be injected into the slurry prior to preheating to suppress formation of sulfur dioxide during this step.

Preheated coal slurry may, before entering the reaction system, be augmented by hot ash slurry recycled from the bottom of the acid scrubber. This "internal recycle" increases the fluidity of the slurry and, by increasing the exposure of residual carbon in the ash to oxidizing conditions, is a useful means, in some cases, of obtaining a high carbon conversion. With certain types of reaction systems the "thermal flywheel" effect of internal recycle also helps to avoid undesirably high reaction temperatures. It is thermally and hydraulically more efficient to recycle acid internally than externally so that the latter would usually be limited to an amount facilitating the slurrying and pumping of the coal feed.

Basic requirements of a reaction system for the process comprise containment for the reactants providing sufficient retention time for the combustion to be essentially completed, good mixing of gas and slurry phases and means of transferring and/or absorbing combustion heat so that an allowable temperature is not exceeded. Air and fuel slurry may enter a reactor at the same point and flow together through an elongated reaction space. FIG. 1 illustrates such a concurrent type of reactor. Or, air may enter at the bottom of a vertical reactor in which fuel slurry enters at a higher level. In such case slurry would usually comprise a continuous phase and the flow of reactant phases would be essentially counter-current.

With the concurrent reactor type mixing may be obtained by maintaining a so-called "turbulent flow" velocity or by the insertion of stationery or mechanical mixing devices. In the counter-current type bubbling of the dispersed air through the slurry would usually provide sufficient mixing although mixing devices may also be employed.

The reaction system of the illustrated embodiment consists of two concurrent stages in series with respect to heat transfer but only a single stage with respect to the flow of reactants. It is quite feasible, however, to have two or more separate concurrent reaction stages with phase separation between stages in which case the flow of phases between stages would be counter-current.

Counter-current reactors for the process can quite readily be designed to provide two or more reaction stages, for example, by allowing the slurry to flow across each in turn of a series of bubble trays, placed one above another, while the gas phase bubbles upward through the levels of slurry on the respective trays.

On the commercial scale major heating services, such as generating steam, will usually require a plurality of parallel reaction units. For different heating services, such as generating and superheating steam, preheating flue gas, etc., reaction units may be either in series or parallel, with respect to flow of reactants, or a combination of both. It is not necessary that parallel or series reaction units, or stages, operate at the same temperature.

The primary method of controlling the temperatures in the reactors of the various types is indirect transfer of combustion heat through heat transfer surface to a heat transfer medium such as boiling water. Another method, usually auxiliary to the first, is to absorb combustion heat as sensible and, to a lesser degree, latent heat imparted to recycled acid or ash slurry serving as a "thermal flywheel". Heat so absorbed must be recovered by transfer to a heat transfer medium through surface located downstream of the reaction system. The heat liberation is large in comparison with reactor volume. Even with ingenious means of transferring this heat, such as, in the counter-current type, circulating slurry through an external exchanger, the auxiliary method may be advantageous or necessary.

Although influenced by the "rank", or refractoryness, of the coal, excess air and pressure, combustion proceeds rapidly at temperatures which are low by comparison with conventional combustion. Generally, a range from 600 to 1400 degrees F. may be employed. For applications in which process heat, rather than power, is required operation at the lower end of the temperature range, where equipment specifications are less demanding, may be satisfactory. However, to generate steam at a pressure customary for power plants a combustion temperature of 700 degrees F., or higher, is preferred. Superheating steam obviously requires combustion heat be made available at a temperature in excess of the desired steam temperature, for example, in the range of 1000 to 1200 degrees F.

Since the maximum atmospheric boiling point of sulfuric acid solutions (that of the Constant Boiling Mixture) is only about 640 degrees F. it is apparent that, in order to maintain a liquid (or slurry) phase, the combustion must be carried out under pressure. Increasing pressure also aids in suppressing the dissociation of sulfur trioxide to the undesirable dioxide. Thus, the temperature at which heat is required is the primary determinant of operating pressure. Economic considerations may, however, dictate the use of a pressure higher than otherwise required because, although air compression becomes more expensive, vessels, heat exchangers and piping become smaller. While a pressure range of 10 to 500 pounds per square inch is contemplated the lower end of the range is feasible only with relatively low temperature heat outputs.

In order to take advantage of the high boiling point and correspondingly low volatility of concentrated sulfuric acid the acid concentration in the liquid phase during the combustion is normally between 90 and 100 percent, preferably between 95 percent and the composition of the Constant Boiling Mixture (98.3 percent at atmospheric pressure).

Upon completion of the combustion reactions high level heat is recovered from the reaction effluent by means of more-or-less conventional heat exchangers. Heat recovered in this position may be a minor part of the total output of the process, in the case of little or no internal recycle, or a major part in the case of a high rate of internal recycle. Examples of such recovery are steam generation, steam superheating or reheating and preheating or reheating flue gas prior to expansion.

Following high level heat recovery reaction effluent flows to equipment for phase separation and rectification such as referred to in the accompanying description as an acid scrubber.

Water enters the system as coal moisture, humidity in the combustion air and as the product of combustion of hydrogen in the coal. It may also be added in the form of dilute acid being recovered. Essentially all of the water input must be separated from the circulating acid to avoid dilution. At the same time, acidic components must be removed from the flue gas to an extremely low tolerance. These are functions of the acid scrubber. Heat input is in the form of the heat content of reaction effluent entering the "flash zone" of the scrubber. Usually, there is a little "over-flash" at this point. In other words, the vapor-liquid ratio at the flash zone is slightly greater than the ratio of the flue gas to ash slurry. Hot flash zone vapors flow upward through a series of contacting elements, such as perforated plates or bubble trays, counter-current to a cooler stream of acid solution. A bed packed with bulk contact elements, such as Rashig rings, could be used in place of the plates or trays. The acid solution is recirculated by a pump and cooled externally to the scrubber by transfer of heat as appropriate to the heat economy of the installation, for example to boiler feedwater, flue gas to be expanded, etc. The temperature spread between flash zone and scrubber overhead is controlled by the amount and temperature of acid solution circulated so that the specified separation between water vapor and sulfur trioxide (and/or, in some cases, sulfur dioxide) is achieved. Acid solution corresponding to the over-flash flows downward from the lowest contacting element to join the ash slurry in the bottom of the scrubber. While this comparatively simple absorption technique may often suffice it is within the scope of the invention to employ more sophisticated vapor-liquid fractionating techniques, such as a refluxed rectification zone, a reboiler, etc. to meet particularly exacting requirements.

As noted in Background of the Invention, equilibrium partial pressures of sulfur dioxide, oxygen, sulfur trioxide, water vapor and sulfuric acid are inter-related according to well known thermodynamic principles. Oxygen and water vapor are normal and harmless flue gas ingredients. Sulfur trioxide and sulfuric acid are readily condensed and removed. The critical constituent is sulfur dioxide. Fortunately, at the low temperatures and elevated pressures preferred for this combustion, the equilibrium concentration of this pollutant is low.

However, to obtain maximum efficiency in an energy system as a whole it may be desired, especially with relatively low operating pressures, to specify a combustion temperature at which the equilibrium content of sulfur dioxide is not quite low enough to be ignored. In this event there are mechanisms for preventing excessive contamination of flue gas released to the atmosphere. These mechanisms are of two kinds, conversion and absorption. The reactive environment provided by the acid scrubber, at a temperature appreciably lower than that of the combustion, can result in recombination of sulfur dioxide, excess oxygen and water vapor to sulfuric acid which transfers to the liquid phase almost quantitatively. This reaction is not necessarily confined to the gaseous phase and may be encouraged by adding a finely divided, or acid soluble, catalytic agent to the circulating acid solution. A more positive way to convert higher concentrations of the dioxide is to pass the flue gas, which has been thoroughly washed or otherwise freed of ash entrainment, through a bed of solid catalyst similar to that employed in the contact process of sulfuric acid manufacture.

As with all catalytic conversions the temperature must be controlled within a range in which equilibrium and reaction rate are suitable. Fortunately, increased pressure favors both equilibrium and rate so that the catalyst volume required is comparatively small and considerable temperature flexibility is permitted, for example a range of about 650 to 850 degrees F.

Strong sulfuric acid is an excellent solvent for sulfur dioxide so that, with due attention to acid circulation and content of dissolved dioxide, it can effectively absorb this pollutant from the flue gas. When handling relatively large amounts of the dioxide by this mechanism it may be necessary to regenerate a slip-stream of the recirculating acid according to the art known to processes in which conventional flue gasses are scrubbed with this solvent for sulfur dioxide removal. Dioxide may be allowed to remain dissolved in acid recycled to the reaction system since, by entering into the aforementioned equilibria, it causes a corresponding reduction in the amount formed.

The slurry phase separated from flue gas in the acid scrubber comprises essentially the unburned portions of the coal charged suspended in roughly the same amount of acid as used to slurry the coal. Actually, the acid will have been increased slightly by combustion of sulfur in the coal and will also carry whatever acid soluble minerals were contained in this particular coal. The flow of ash slurry may be considerably in excess of the net production in cases where internal recycling is employed.

The net production of ash slurry is cooled by heat exchange and subjected to solids-liquid separation. There are various methods of performing this familiar Chemical Engineering unit operation but those, such as setting and centrifuging, which rely on difference in density between solid and liquid may not be suitable because of the relatively high density of strong sulfuric acid. Filtration would usually be a more suitable method. Since most of the separated acid will be recycled to coal slurry and the net production is, in any event, of rather low quality, it may not be essential that solids removal be quantitative. It is necessary that sufficient ash be separated to avoid undesirable accumulation in the recycled acid.

If the quantity of acid clinging to the separated ash represents either a disposal problem or an appreciable economic loss it may be washed from the ash with water. Washed or unwashed ash may also be neutralized by mixing with a alkaline agent such as limestone slurry. Washed and/or neutralized ash may be disposed of as an aqueous slurry or dewatered by conventional means as best suits the local conditions.

Although the rectification section of the acid scrubber can be operated under conditions such that the amounts of sulfur trioxide and sulfuric acid in true vapor state are miniscule, entrainment of fine droplets of liquid acid (so-called "acid mist") can be a problem. The first defense against such carryover is an efficient mist extractor. However, even with the best mist extractors there may still be a risk of acid corrosion in downstream equipment, notably flue gas turbines.

There is also another potential source of acid contamination in the flue gas. Some coals contain chlorides. When heated with sulfuric acid they form hydrogen chloride which, being more volatile than sulfur trioxide, passes through the acid scrubber in vapor state.

So long as the quantities of these acidic contaminents are small they may be dealt with most simply by passing the flue gas through a guard chamber packed with crushed limestone. If the rate of consumption of the limestone is such that continuity of operation is impaired, a pair of guard chambers may be used, one being on-stream while the packing in the other is being replaced. Although some labor cost is entailed in the use of guard chambers this method has the advantage over scrubbing with aqueous alkali solutions or slurries that the gas does not have to be cooled to a temperature compatable with liquid water and subsequently reheated.

If the production of hydrogen chloride is large enough to justify recovery, then cooling and water absorption become necessary and the final neutralization may as well be carried out by the scrubbing method. The technology of hydrogen chloride absorption and recovery is well established and does not comprise a novel feature of my invention.

Air required for the combustion is compressed in large, efficient rotary compressors, usually of the axial-flow type. Depending upon operating pressure selected, the compression may be completed within a single machine or there may be two such machines, or stages, arranged in series. In the latter case partially compressed air would be cooled between stages by heat exchange with a relatively cold incoming stream, usually boiler feedwater. In this manner not only the heat of compression but also the heat equivalent of compressor inefficiency can be conserved. After maximum practical recovery of interstage heat the air may be further cooled by exchange with atmospheric air or plant cooling water. Although such final interstage cooling minimizes the consumption of power in the subsequent compression stage, it is thermally inefficient and may be omitted. Fully compressed air is not cooled, its heat content being useful as combustion preheat, recoverable along with the main heat output from the reactors.

Potential energy in scrubbed and neutralized flue gas is similarly recovered in large, efficient turbo-expanders. There will usually (but not necessarily) be the same number of stages of flue gas expansion as of air compression and turbines will be mechanically coupled with and deliver power to the corresponding compressor. While the designer has considerable flexibility for optimizing the flow scheme for a particular case, it would be usual to preheat the flue gas (and reheat, if more than one stage) to a temperature providing a power balance between turbines and compressors. It may even be attractive, in some circumstances, to heat the flue gas sufficiently to generate excess power for export. Flue gas may be heated by exchange with hot circulating acid, reactor effluent and/or the reactors, themselves.

Having described my invention, I claim:

1. A combustion process in which a sulfur-containing fuel is burned in a combustion zone to which it is charged as a slurry in sulfuric acid solution.

2. A process as in claim 1 in which the concentration of sulfuric acid in the solution is between 90 and 100 percent.

3. A process as in claim 1 in which the fuel slurry is charged to the combustion zone along with combustion air and which comprises the additional steps of:

extracting useful heat;

separating the combustion zone effluent into a flue gas and a slurry of ash in recovered sulfuric acid solution;

separating the ash from the recovered sulfuric acid solution; and recycling a portion of the recovered sulfuric acid solution to the fuel slurry.

4. A process as in claim 1 in which the fuel slurry is charged to a first combustion zone along with partially exhausted air and which comprises the additional steps of:

extracting useful heat from the first combustion zone;

separating a first combustion zone effluent into a flue gas and a slurry of partially burned fuel;

charging the slurry of partially burned fuel along with combustion air to a second combustion zone;

extracting useful heat from the second combustion zone;

separating a second combustion zone effluent into the partially exhausted air and a slurry of ash in recovered sulfuric acid solution;

conducting the partially exhausted air to the first combustion zone;

separating the ash from the recovered sulfuric acid solution; and recycling a portion of the recovered sulfuric acid solution to the fuel slurry.

5. A process as in claim 3 in which the temperature in the combustion zone is between 600 and 1400 degress F. and the pressure is between 10 and 500 pounds per square inch.

6. A process as in claim 3 in which a portion of the slurry of ash in recovered sulfuric acid solution is recycled to the combustion zone.

7. A process as in claim 3 in which the flue gas is contacted in counter-current manner with a recirculating stream of cooled sulfuric acid solution.

8. A process as in claim 3 in which the flue gas is contacted with a catalyst of the type used in the contact process of sulfuric acid manufacture.

9. A process as in claim 3 in which the step of extracting useful heat comprises transferring the useful heat through heat transfer surface to boiler feedwater so as to convert a portion of the boiler feedwater to steam.

* * * * *